US009346302B1

(12) United States Patent
Chen

(10) Patent No.: US 9,346,302 B1
(45) Date of Patent: May 24, 2016

(54) PRINTER

(71) Applicant: HiTi Digital, Inc., New Taipei (TW)

(72) Inventor: Wei-Hung Chen, New Taipei (TW)

(73) Assignee: HiTi Digital, Inc., New Taipei (TW)

( * ) Notice: Subject to any disclaimer, the term of this patent is extended or adjusted under 35 U.S.C. 154(b) by 0 days.

(21) Appl. No.: 14/614,420

(22) Filed: Feb. 5, 2015

(30) Foreign Application Priority Data

Dec. 9, 2014 (TW) ..... 103142866 A

(51) Int. Cl.
*B41J 35/28* (2006.01)
*B41J 35/04* (2006.01)
*B41J 32/00* (2006.01)

(52) U.S. Cl.
CPC . *B41J 35/04* (2013.01); *B41J 32/00* (2013.01)

(58) Field of Classification Search
None
See application file for complete search history.

(56) References Cited

U.S. PATENT DOCUMENTS 4,807,077 A * 2/1989 Zaitsu ..... G11B 23/087 360/132
2007/0285453 A1* 12/2007 Kariya ..... B41J 11/46 347/16

FOREIGN PATENT DOCUMENTS

TW 200744867 A 12/2007
TW 200831305 A 8/2008

* cited by examiner

*Primary Examiner* — Alejandro Valencia
(74) *Attorney, Agent, or Firm* — CKC & Partners Co., Ltd.

(57) ABSTRACT

A printer includes a casing, a cover, a ribbon cassette and a ribbon spool. The casing has a space and an opening. The cover is pivotally connected to the casing, and configured to close the opening. The cover has a protruding portion facing the space. The ribbon cassette is detachably accommodated in the space. The ribbon cassette includes elastic arms, at least one of which has a first hooking structure. The ribbon spool is detachably and pivotally connected to the ribbon cassette. The ribbon spool includes a second hooking structure. Before the cover closes the opening, the second and the first hooking structures are mutually locked. When the cover closes the opening, the protruding portion inserts between the elastic arms, such that the first hooking structure detaches from the second hooking structure, allowing rotational freedom of the ribbon spool relative to the ribbon cassette.

9 Claims, 6 Drawing Sheets

PRINTER

RELATED APPLICATIONS

This application claims priority to Taiwan Application Serial Number 103142866, filed Dec. 9, 2014, which is herein incorporated by reference.

BACKGROUND

1. Technical Field

The present disclosure relates to printers. More particularly, the present disclosure relates to sublimation printers.

2. Description of Related Art

During use of a sublimation printer, the ribbon is a consumable and therefore needs to be replaced. After the ribbon is installed in a ribbon cassette, the ribbon often rotates due to vibration during the transportation process, causing the ribbon to be dragged out from the ribbon cassette. When the customer removes the packaging, the ribbon may have already moved away from its original position after manufacture. This can easily lead to problems such as the loss of a piece of ribbon consumable or the ribbon getting stuck.

In order to overcome the above problems, an additional plastic piece (or another material) is commonly used in the existing ribbon cassette to fix the ribbon, so as to prevent the ribbon spool from rotating. When the customer has to use the ribbon, the fixing piece of the ribbon is then removed.

However, if an additional plastic piece (or another material) is used to fix the ribbon, additional assembly time, manpower, and cost are involved. Thus, the cost for consumables is correspondingly increased.

SUMMARY

A technical aspect of the present disclosure provides a printer, in which, prior to a ribbon cassette being installed in the printer, including during transport of the ribbon cassette, a ribbon spool does not rotate relative to the ribbon cassette to thereby prevent the problem of a ribbon being dragged out.

According to an embodiment of the present disclosure, a printer includes a casing, a cover, a ribbon cassette and a ribbon spool. The casing has a space and an opening communicated with the space. The cover is pivotally connected to the casing, and is configured to close the opening. The cover has at least one protruding portion facing the space. The ribbon cassette is detachably accommodated in the space. The ribbon cassette includes at least one pair of elastic arms oppositely disposed. At least one of the elastic arms has a first hooking structure facing the other one of the elastic arms. The ribbon spool is detachably and pivotally connected to the ribbon cassette. The ribbon spool includes a second hooking structure located corresponding to the first hooking structure. Before the cover closes the opening, the second hooking structure and the first hooking structure are mutually locked, so as to restrict rotation of the ribbon spool relative to the ribbon cassette. When the cover closes the opening, the protruding portion inserts between the elastic arms, such that the elastic arms move away from each other. Then, the first hooking structure detaches from the second hooking structure, allowing rotational freedom of the ribbon spool relative to the ribbon cassette.

In one or more embodiments of the present disclosure, the ribbon cassette includes a carrier tray and two terminal plates. The carrier tray has an accommodation slot. The ribbon spool is at least partially accommodated in the accommodation slot. The terminal plates are connected to two opposite sides of the carrier tray. The elastic arms are connected between one of the terminal plates and the carrier tray. Each of the terminal plates includes a first pivoting portion disposed along an axis, and the ribbon spool is detachably and pivotally connected to the first pivoting portion along the axis.

In one or more embodiments of the present disclosure, the ribbon spool further includes a shaft body and two second pivoting portions. The shaft body is accommodated in the accommodation slot. The second pivoting portions are respectively located at the two opposite ends of the shaft body along the axis, and respectively, detachably and pivotally connected with the first pivoting portions. The second hooking structure is located between one of the second hooking structures and the shaft body.

In one or more embodiments of the present disclosure, the second hooking structure includes at least one first hook disposed around the axis.

In one or more embodiments of the present disclosure, the quantity of the first hook is plural. The first hooks are evenly disposed around the axis.

In one or more embodiments of the present disclosure, the first hooking structure is a protruding structure snapped between the first hooks, so as to restrict the rotation of the ribbon spool.

In one or more embodiments of the present disclosure, each of the elastic arms has the first hooking structure. Each of the first hooking structures is a protruding structure. Each of the protruding structures is configured to mutually abut with the first hook, so as to restrict the rotation of the ribbon spool in a direction.

In one or more embodiments of the present disclosure, each of the elastic arms has the first hooking structure. Each of the first hooking structures is a recessed structure. Each of the recessed structures is configured to mutually abut with the first hook, so as to restrict the rotation of the ribbon spool in a direction.

In one or more embodiments of the present disclosure, each of the elastic arms includes a first arm section and a second arm section. The first arm section has oppositely a first end and a second end. The first end is connected between one of the terminal plates and the carrier tray. The second end extends away from the opening. A spacing between the second ends is at least two times larger than a maximum distance between an outer periphery of the second hooking structure and the axis. The second arm section has oppositely a third end and a fourth end. The third end is connected to the corresponding second end. The fourth end extends towards the opening. The first hooking structure is located at a side of the corresponding second arm section facing the other second arm section.

When compared with the prior art, the above-mentioned embodiments of the present disclosure have at least the following advantages:

(1) Due to the abutting by the first hooking structure, the second hooking structure and the first hooking structure are mutually locked, and thus the ribbon spool is not able to rotate relative to the ribbon cassette. Consequently, the problem of the ribbon that is wrapped around the outer periphery of the ribbon spool being dragged out is prevented, and this is beneficial before the ribbon cassette is installed in the casing of the printer, including during transport of the ribbon cassette.

(2) The mechanism to prevent the ribbon spool from rotating relative to the ribbon cassette does not require any additional element, and the mechanism to detach the first hooking structure from the second hooking structure and thereby allow rotational freedom of the ribbon spool relative to the ribbon cassette does not require any additional tool. Therefore, through such simple mechanisms, assembly time for the printer and material costs can both be reduced, and convenient operation is afforded to users.

(3) Since the spacing between the second ends of the elastic arms is at least two times larger than the maximum distance between an outer periphery of the second hooking structure and the axis, when the ribbon spool is pivotally connected with the ribbon cassette, the second hooking structure of the ribbon spool will not contact with the elastic arms of the ribbon cassette, and the second hooking structures of the ribbon spool can be easily and pivotally connected with the first pivoting portions of the ribbon cassette.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
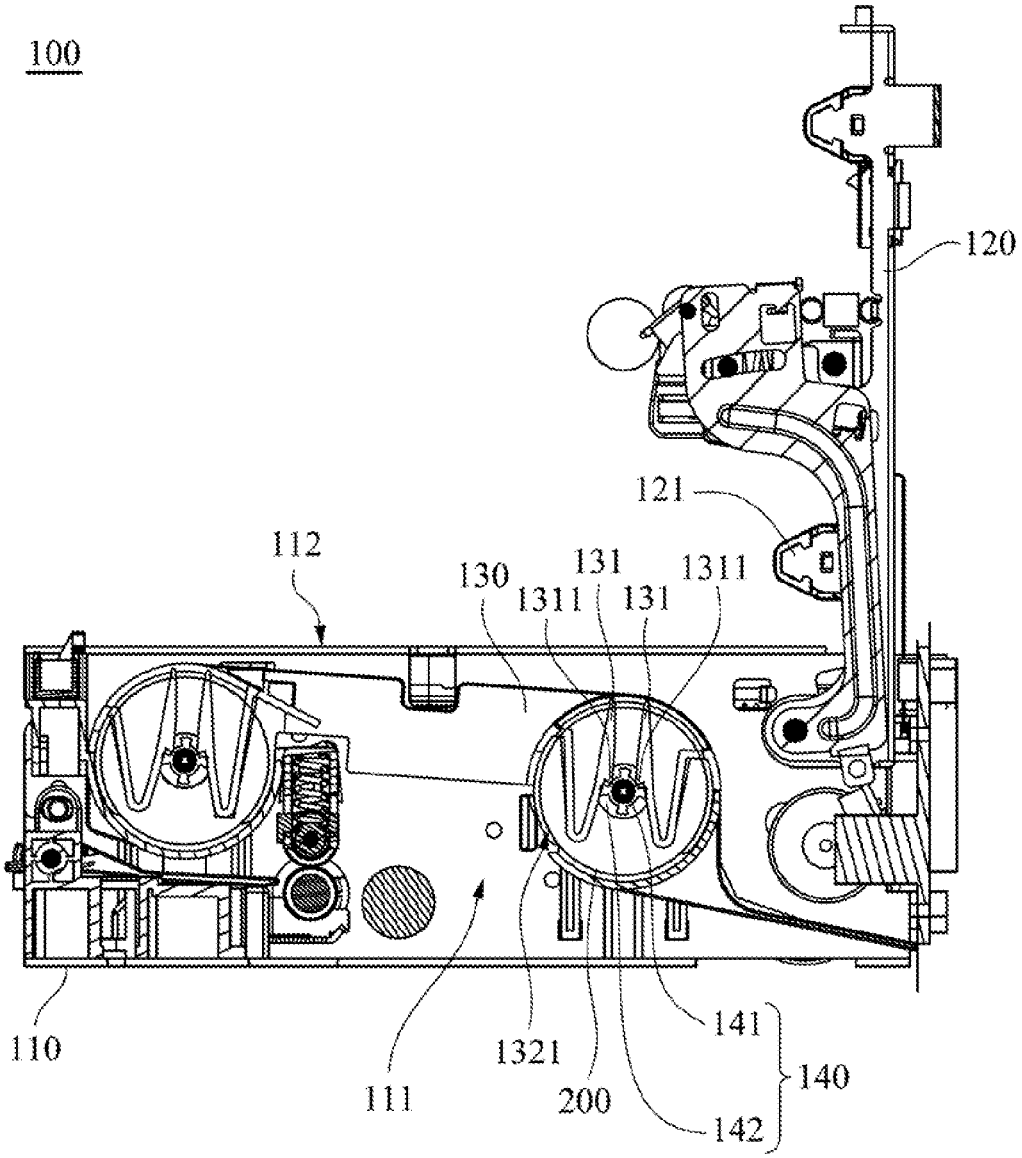
FIG. 1 is a sectional view of a printer according to an embodiment of the present disclosure, in which a cover of the printer is shown in a state exposing an opening.

Drawings will be used below to disclose a plurality of embodiments of the present disclosure. For the sake of clear illustration, many practical details will be explained together in the description below. However, it is appreciated that the practical details should not be used to limit the claimed scope. In other words, in some embodiments of the present disclosure, the practical details are not essential. Moreover, for the sake of drawing simplification, some customary structures and elements in the drawings will be schematically shown in a simplified way. Wherever possible, the same reference numbers are used in the drawings and the description to refer to the same or like parts.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 2:
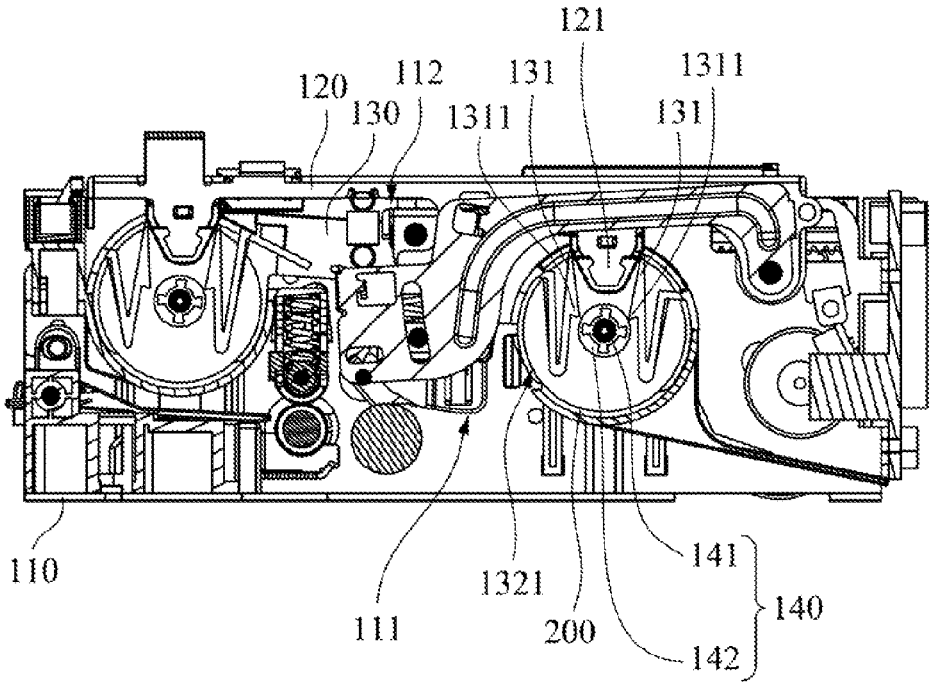
FIG. 2 is a sectional view of the printer of FIG. 1, in which the cover of the printer is shown in a state closing the opening.

FIG. 1 is a sectional view of a printer 100 according to an embodiment of the present disclosure, in which a cover 120 of the printer 100 is shown in a state exposing an opening 112. FIG. 2 is a sectional view of the printer 100 of FIG. 1, in which the cover 120 of the printer 100 is shown in a state closing the opening 112. As shown in FIGS. 1 and 2, the printer 100 includes a casing 110, the cover 120, a ribbon cassette 130 and a ribbon spool 140. The casing 110 has a space 111, and the opening 112 is communicated with the space 111. The cover 120 is pivotally connected to the casing 110, and is configured to close the opening 112. The cover 120 has at least one protruding portion 121. In this embodiment, the quantity of the protruding portion 121 is two. The protruding portions 121 face the space 111 (when the cover 120 closes the opening 112). The ribbon cassette 130 is detachably accommodated in the space 111. The ribbon cassette 130 includes at least one pair of elastic arms 131 oppositely disposed. At least one of the elastic arms 131 has a first hooking structure 1311 facing the other one of the elastic arms 131. In this embodiment, each of the elastic arms 131 has the first hooking structure 1311, and the first hooking structures 1311 face each other. The ribbon spool 140 is detachably and pivotally connected to the ribbon cassette 130. The ribbon spool 140 includes a second hooking structure 141 located corresponding to the first hooking structure 1311. Before the cover 120 closes the opening 112, the second hooking structure 141 and the first hooking structure 1311 are mutually locked, so as to restrict rotation of the ribbon spool 140 relative to the ribbon cassette 130. When the cover 120 closes the opening 112, the protruding portion 121 inserts between the elastic arms 131, such that the elastic arms 131 move away from each other. Subsequently, the first hooking structure 1311 detaches from the second hooking structure 141, allowing rotational freedom of the ribbon spool 140 relative to the ribbon cassette 130.

In other words, the elastic arms 131 exert an urging force toward each other due to their elasticity, such that the first hooking structure 1311 abuts against the second hooking structure 141, and the second hooking structure 141 and the first hooking structure 1311 are mutually locked. If no force is exerted overcoming the elastic strength of the elastic arms 131 to make the elastic arms 131 move away from each other, the second hooking structure 141 will remain mutually locked with the first hooking structure 1311, so as to restrict rotation of the ribbon spool 140 relative to the ribbon cassette 130. In this way, due to the abutting by the first hooking structure 1311, the second hooking structure 141 and the first hooking structure 1311 are mutually locked, and thus the ribbon spool 140 is not able to rotate relative to the ribbon cassette 130. Consequently, the problem of the ribbon 200 that is wrapped around the outer periphery of the ribbon spool 140 being dragged out is prevented, and this is beneficial before the ribbon cassette 130 is installed in the casing 110 of the printer 110, including during transport of the ribbon cassette 130.

When the ribbon cassette 130 is accommodated in the space 111 of the casing 110 and the printer 100 is switched on, the cover 120 closes the opening 112. At this point, the protruding portion 121 of the cover 120 inserts between the elastic arms 131, and the protruding portion 121 exerts a force larger than the force due to the elasticity of the elastic arms 131, causing the elastic arms 131 to move away from each other. Subsequently, the first hooking structure 1311 detaches from the second hooking structure 141, allowing rotational freedom of the ribbon spool 140 relative to the ribbon cassette 130. The aforementioned mechanism to prevent the ribbon spool 140 from rotating relative to the ribbon cassette 130 does not require any additional element. Moreover, detaching the first hooking structure 1311 from the second hooking structure 141 and thereby allowing rotational freedom of the ribbon spool 140 relative to the ribbon cassette 130 does not require any additional tool. As a result, through such simple mechanisms, assembly time for the printer 100 and material costs can both be reduced, and convenient operation is afforded to user.

In this embodiment, as shown in FIGS. 1 and 2, the printer 100 includes two ribbon spools 140, each detachably and pivotally connected to the ribbon cassette 130. In practical applications, one of the ribbon spools 140 is a supplying side, and the other ribbon spool 140 is a receiving side. With the rotation of the ribbon spool 140 acting as the supplying side relative to the ribbon cassette 130, the ribbon spool 140 acting as the supplying side will supply the ribbon 200 to the ribbon spool 140 acting as the receiving side. With the rotation of the ribbon spool 140 acting as the receiving side relative to the ribbon cassette 130, the ribbon spool 140 acting as the receiving side will receive the ribbon 200 from the ribbon spool 140 acting as the supplying side.

Figure 3:
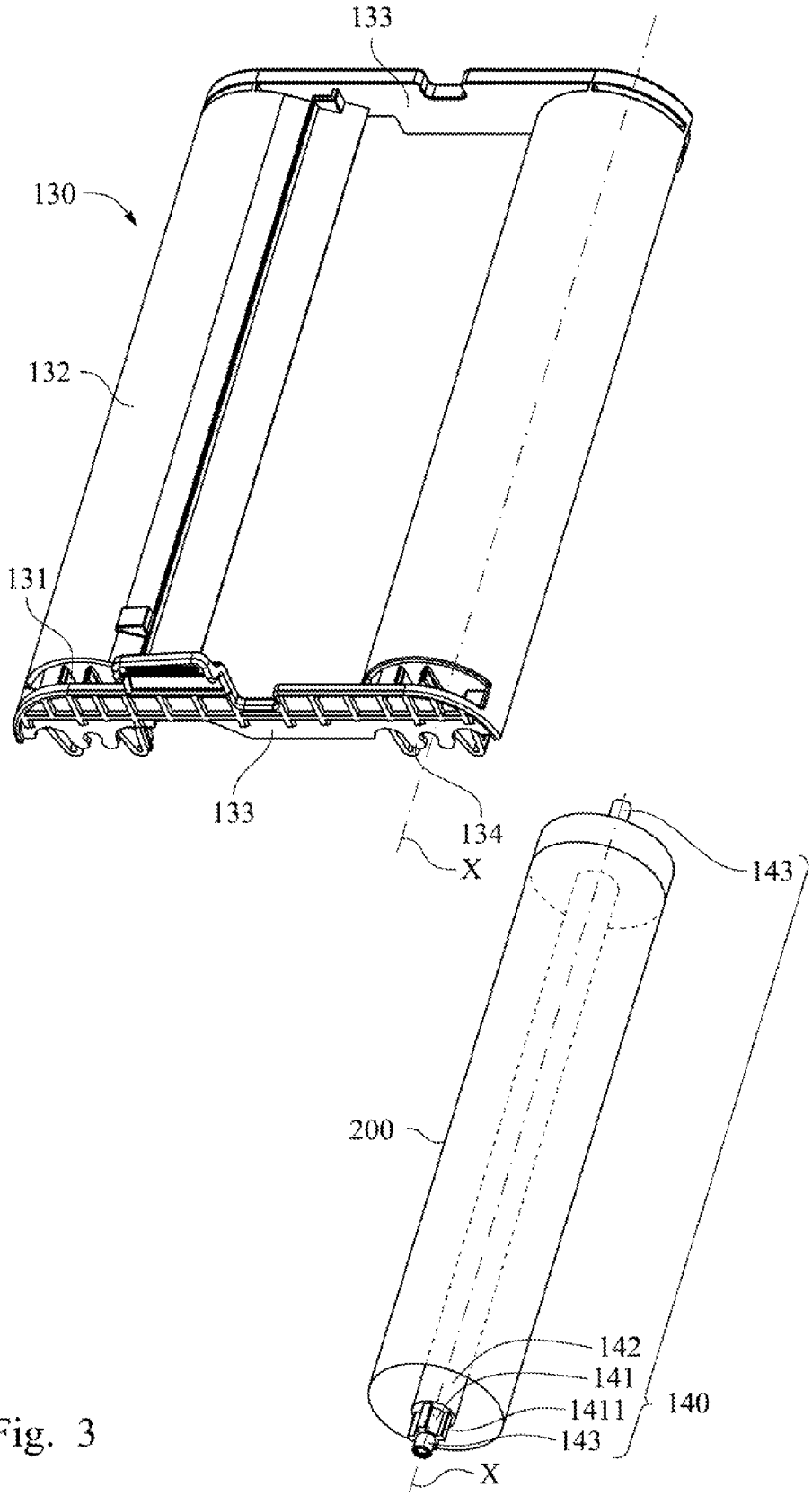
FIG. 3 is a perspective exploded view of the ribbon cassette and the ribbon spool of FIG. 1.

FIG. 3 is a perspective exploded view of the ribbon cassette 130 and the ribbon spool 140 of FIG. 1. As shown in FIG. 3, the ribbon cassette 130 includes a carrier tray 132 and two terminal plates 133. The carrier tray 132 has an accommodation slot 1321 which does not appear in FIG. 3, but does appear in FIGS. 1 and 2 and is located on the carrier tray 132 as viewed from the bottom in FIG. 3. With continued reference to FIGS. 1 and 2, the ribbon spool 140 is at least partially accommodated in the accommodation slot 1321. As shown in FIG. 3, the terminal plates 133 are connected to two opposite sides of the carrier tray 132. The elastic arms 131 are connected between one of the terminal plates 133 and the carrier tray 132. In this embodiment, the elastic arms 131 are connected between the terminal plate 133 that is located at a lower part of FIG. 3 and the carrier tray 132. Each of the terminal plates 133 includes a first pivoting portion 134 (in FIG. 3, the first pivoting portions 134 of the terminal plate 133 that is located at an upper part of FIG. 3 are not visible as they are blocked by the carrier tray 132). The first pivoting portions 134 of the two terminal plates 133 are disposed along an axis X. The ribbon spool 140 is detachably and pivotally connected to the first pivoting portions 134 along the axis X.

To be more specific, the ribbon spool 140 further includes a shaft body 142 and two second pivoting portions 143. As shown in FIGS. 1 and 2, the shaft body 142 is accommodated in the accommodation slot 1321. As shown in FIG. 3, the second pivoting portions 143 are respectively located at two opposite ends of the shaft body 142 along the axis X, and respectively, detachably and pivotally connected with the first pivoting portions 134. The second hooking structure 141 is located between one of the second pivoting portions 143 and the shaft body 142. In this embodiment, the second hooking structure 141 is located between the second pivoting portion 143 that is located at the lower part of FIG. 3 and the shaft body 142.

Figure 4:
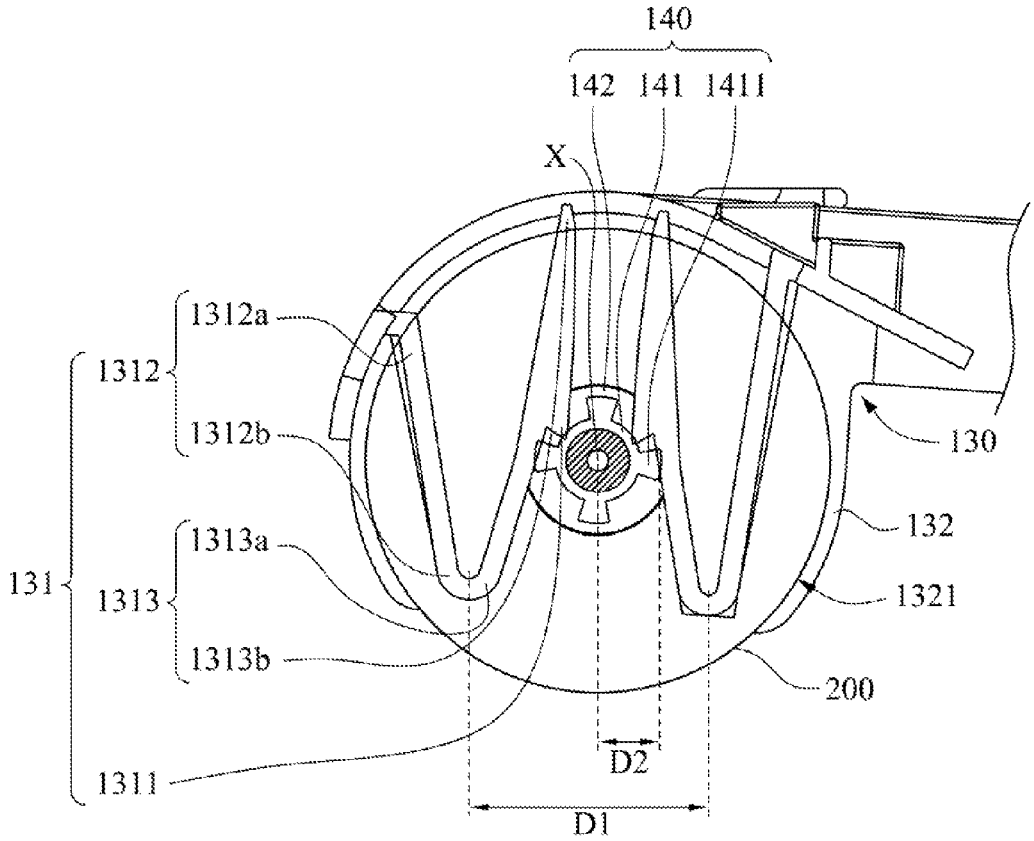
FIG. 4 is an enlarged view of the elastic arms of FIG. 1.

FIG. 4 is an enlarged view of the elastic arms 131 of FIG. 1. As shown in FIG. 4, each of the elastic arms 131 includes a first arm section 1312 and a second arm section 1313. The first arm section 1312 has oppositely a first end 1312*a* and a second end 1312*b*. As shown in FIGS. 3 and 4, the first end 1312*a* is connected between one of the terminal plates 133 and the carrier tray 132. As mentioned above, in this embodiment, the elastic arms 131 are connected between the terminal plate 133 that is located at the lower part of FIG. 3 and the carrier tray 132. This means that the first ends 1312*a* of the first arm sections 1312 are connected between the terminal plate 133 that is located at the lower part of FIG. 3 and the carrier tray 132. The second ends 1312*b* of the first arm sections 1312 extend away from the opening 112. As shown in FIG. 4, a spacing D1 between the second ends 1312*b* is at least two times larger than a maximum distance D2 between an outer periphery of the second hooking structure 141 and the axis X. In this way, when the ribbon spool 140 is assembled from the bottom of the ribbon cassette 130 as shown in FIG. 4 and is pivotally connected with the ribbon cassette 130, the second hooking structure 141 of the ribbon spool 140 will not contact with the elastic arms 131 of the ribbon cassette 130, and the second hooking structures 143 of the ribbon spool 140 can be easily and pivotally connected with the first pivoting portions 134 of the ribbon cassette 130.

Moreover, the second arm section 1313 has oppositely a third end 1313*a* and a fourth end 1313*b*. The third end 1313*a* is connected to the corresponding second end 1312*b*. The fourth end 1313*b* extends towards the opening 112. In this embodiment, as shown in FIG. 4, the quantity of the elastic arms 131 is two. Each of the elastic arms 131 has the first hooking structure 1311, and the first hooking structure 1311 is located at a side of the corresponding second arm section 1313 facing the other second arm section 1313, so as to allow the second hooking structure 141 and the first hooking structure 1311 to be mutually locked.

In addition, as shown in FIG. 4, each of the first hooking structures 1311 of the elastic arms 131 is a protruding structure. Each of the protruding structures is configured to mutually abut with the first hook 1411 of the second hooking structure 141, so as to restrict the rotation of the ribbon spool 140 in a direction. For example, the protruding structure (i.e., the first hooking structure 1311) of one of the elastic arms 131 is configured to restrict the clockwise rotation of the ribbon spool 140, and the protruding structure (i.e., the first hooking structure 1311) of the other of the elastic arms 131 is configured to restrict the anti-clockwise rotation of the ribbon spool 140, such that both the clockwise and anti-clockwise rotations of the ribbon spool 140 relative to the ribbon cassette 130 are restricted.

Figure 5:
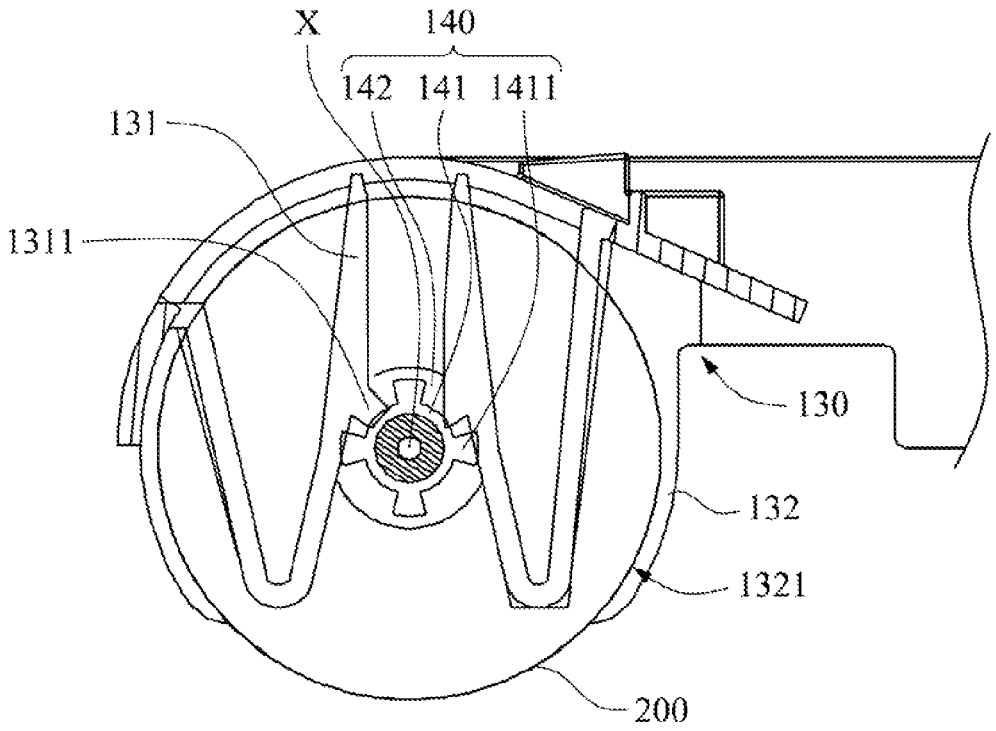
FIG. 5 is an enlarged view of elastic arms of a printer according to another embodiment of the present disclosure.

FIG. 5 is an enlarged view of elastic arms 131 of a printer 100 according to another embodiment of the present disclosure. As shown in FIG. 5, the first hooking structure 1311 is also a protruding structure, and is snapped between the first hooks 1411. Thus, this single first hooking structure 1311 is enough to restrict the clockwise and anti-clockwise rotations of the ribbon spool 140.

Figure 6:
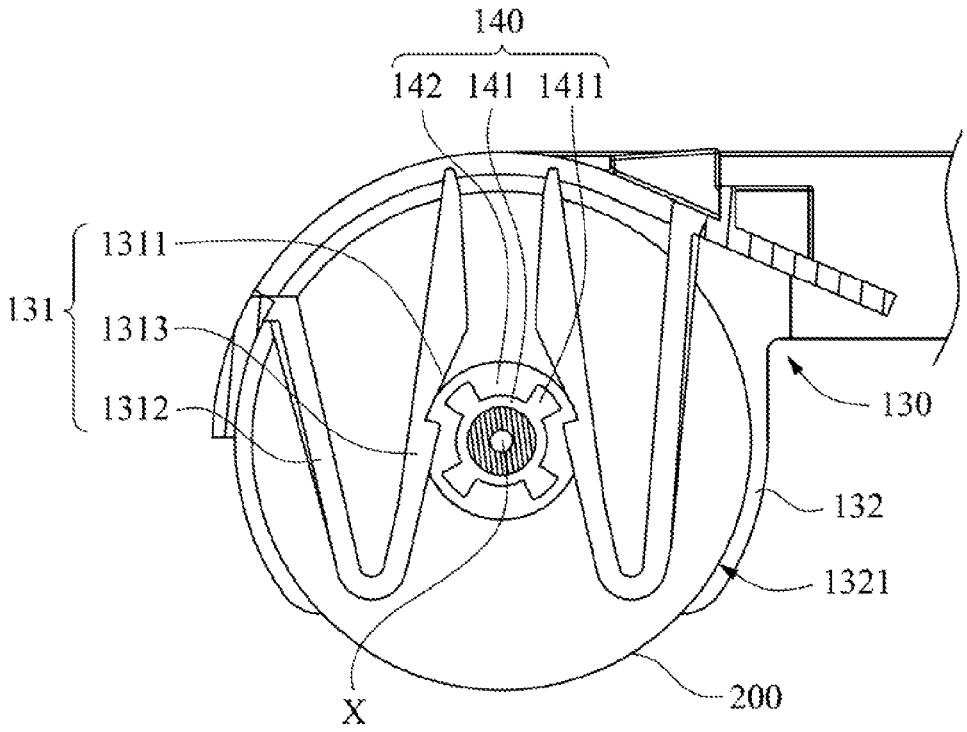
FIG. 6 is an enlarged view of elastic arms of a printer according to a further embodiment of the present disclosure.

FIG. 6 is an enlarged view of elastic arms 131 of a printer 100 according to a further embodiment of the present disclosure. In this embodiment, as shown in FIG. 6, each of the first hooking structures 1311 of the elastic arms 131 is a recessed structure. Each of the recessed structures is configured to mutually abut with one of the first hooks 1411 of the second hooking structure 141, so as to restrict the rotation of the ribbon spool 140 in a direction. Similarly, for example, the recessed structure (i.e., the first hooking structure 1311) of one of the elastic arms 131 is configured to restrict the clockwise rotation of the ribbon spool 140, and the recessed structure (i.e., the first hooking structure 1311) of the other of the elastic arms 131 is configured to restrict the anti-clockwise rotation of the ribbon spool 140, such that both the clockwise and anti-clockwise rotations of the ribbon spool 140 relative to the ribbon cassette 130 are restricted.

In practical applications, the quantity of the first hook 1411 of the second hooking structure 141 is at least one, and can be plural, and the first hooks 1411 are evenly disposed around the axis X. In this embodiment, the quantity of the first hook 1411 is four. However, this does not intend to limit the present disclosure.

Figure 7:
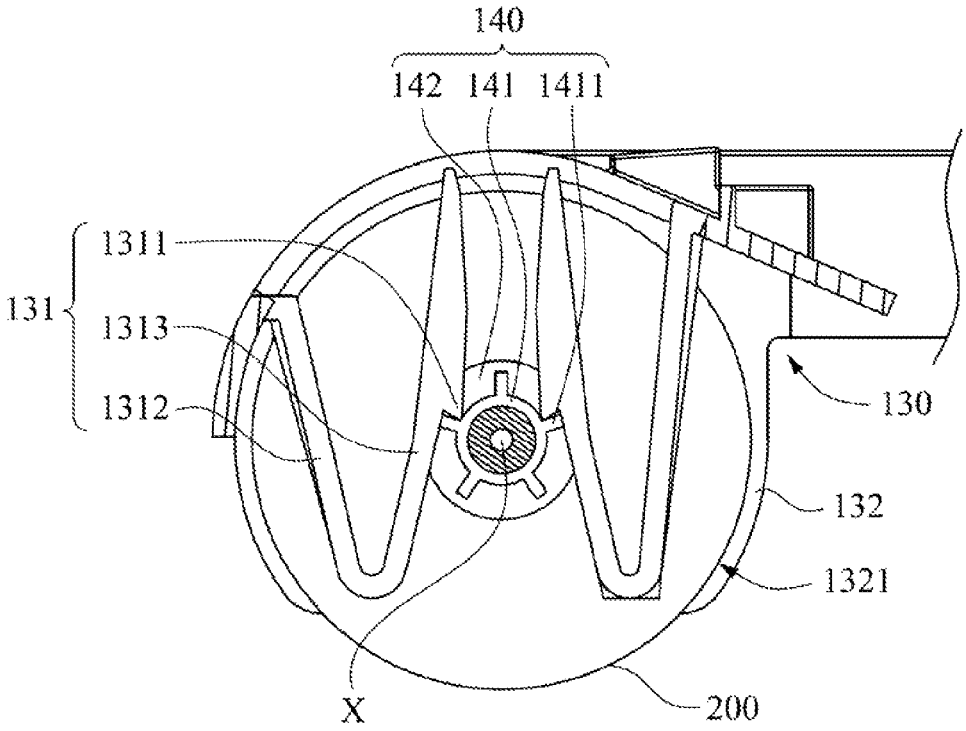
FIG. 7 is an enlarged view of elastic arms of a printer according to a further embodiment of the present disclosure.

FIG. 7 is an enlarged view of elastic arms 131 of a printer 100 according to a further embodiment of the present disclosure. In this embodiment, as shown in FIG. 7, the quantity of the first hook 1411 can be five, depending on actual needs.

In summary, when compared with the prior art, the embodiments of the present disclosure mentioned above have at least the following advantages:

(1) Due to the abutting by the first hooking structure, the second hooking structure and the first hooking structure are mutually locked, and thus the ribbon spool is not able to rotate relative to the ribbon cassette. Consequently, the problem of the ribbon that is wrapped around the outer periphery of the ribbon spool being dragged out is prevented, and this is beneficial before the ribbon cassette is installed in the casing of the printer, including during transport of the ribbon cassette.

(2) The mechanism to prevent the ribbon spool from rotating relative to the ribbon cassette does not require any additional element, and the mechanism to detach the first hooking structure from the second hooking structure and thereby allow rotational freedom of the ribbon spool relative to the ribbon cassette does not require any additional tool. Therefore, through such simple mechanisms, assembly time for the printer and material costs can both be reduced, and convenient operation is afforded to users.

(3) Since the spacing between the second ends of the elastic arms is at least two times larger than the maximum distance between an outer periphery of the second hooking structure and the axis, when the ribbon spool is pivotally connected with the ribbon cassette, the second hooking structure of the ribbon spool will not contact with the elastic arms of the ribbon cassette, and the second hooking structures of the ribbon spool can be easily and pivotally connected with the first pivoting portions of the ribbon cassette.

Although the present disclosure has been described in considerable detail with reference to certain embodiments thereof, other embodiments are possible. Therefore, the spirit and scope of the appended claims should not be limited to the description of the embodiments contained herein.

It will be apparent to the person having ordinary skill in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A printer, comprising:

a casing having a space and an opening communicated with the space;

a cover pivotally connected to the casing, and configured to close the opening, the cover having at least one protruding portion facing the space;

a ribbon cassette detachably accommodated in the space, the ribbon cassette comprising at least one pair of elastic arms oppositely disposed, and at least one of the elastic arms having a first hooking structure facing the other one of the elastic arms; and a ribbon spool detachably and pivotally connected to the ribbon cassette, the ribbon spool comprising a second hooking structure located corresponding to the first hooking structure;

wherein before the cover closes the opening, the second hooking structure and the first hooking structure are mutually locked, so as to restrict rotation of the ribbon spool relative to the ribbon cassette, and when the cover closes the opening, the protruding portion inserts between the elastic arms, such that the elastic arms move away from each other, and the first hooking structure detaches from the second hooking structure, allowing rotational freedom of the ribbon spool relative to the ribbon cassette.

2. The printer of claim 1, wherein the ribbon cassette comprises:

a carrier tray having an accommodation slot, wherein the ribbon spool is at least partially accommodated in the accommodation slot; and two terminal plates connected to two opposite sides of the carrier tray, wherein the elastic arms are connected between one of the terminal plates and the carrier tray, each of the terminal plates comprises a first pivoting portion disposed along an axis, and the ribbon spool is detachably and pivotally connected to the first pivoting portion along the axis.

3. The printer of claim 2, wherein the ribbon spool further comprises:

a shaft body accommodated in the accommodation slot; and two second pivoting portions respectively located at the two opposite ends of the shaft body along the axis, and respectively, detachably and pivotally connected with the first pivoting portions, wherein the second hooking structure is located between one of the second pivoting portions and the shaft body.

4. The printer of claim 3, wherein the second hooking structure comprises at least one first hook disposed around the axis.

5. The printer of claim 4, wherein the quantity of the first hook is plural, and the first hooks are evenly disposed around the axis.

6. The printer of claim 5, wherein the first hooking structure is a protruding structure snapped between the first hooks, so as to restrict the rotation of the ribbon spool.

7. The printer of claim 4, wherein each of the elastic arms has the first hooking structure, each of the first hooking structures is a protruding structure, and at least one of the protruding structures is configured to mutually abut with the first hook, so as to restrict the rotation of the ribbon spool in a direction.

8. The printer of claim 4, wherein each of the elastic arms has the first hooking structure, each of the first hooking structures is a recessed structure, and each of the recessed structures is configured to mutually abut with the first hook, so as to restrict the rotation of the ribbon spool in a direction.

9. The printer of claim 2, wherein each of the elastic arms comprises:

a first arm section having oppositely a first end and a second end, wherein the first end is connected between one of the terminal plates and the carrier tray, the second end extends away from the opening, and a spacing between the second ends is at least two times larger than a maximum distance between an outer periphery of the second hooking structure and the axis; and a second arm section having oppositely a third end and a fourth end, wherein the third end is connected to the corresponding second end, the fourth end extends towards the opening, and the first hooking structure is located at a side of the corresponding second arm section facing the other second arm section.

* * * * *